US010945057B2

(12) United States Patent
May

(10) Patent No.: US 10,945,057 B2
(45) **Date of Patent: *Mar. 9, 2021**

(54) MOTORIZED MICROPHONE RAILS

(71) Applicant: Randall May International, Inc., Irvine, CA (US)

(72) Inventor: Randall L. May, Irvine, CA (US)

(73) Assignee: Randall May International, Inc., Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/023,992

(22) Filed: Jun. 29, 2018

(65) Prior Publication Data

US 2018/0316994 A1 Nov. 1, 2018

Related U.S. Application Data

(63) Continuation of application No. 14/565,864, filed on Dec. 10, 2014, now Pat. No. 10,015,571.

(60) Provisional application No. 61/914,000, filed on Dec. 10, 2013.

(51) Int. Cl.

| | |
|---|---|
| ***H04R 1/02*** | (2006.01) |
| ***H04R 1/08*** | (2006.01) |
| ***G10G 7/00*** | (2006.01) |
| ***G10H 1/32*** | (2006.01) |
| ***G10D 13/08*** | (2020.01) |
| ***G10K 11/00*** | (2006.01) |

(52) U.S. Cl.

CPC ..... *H04R 1/02* (2013.01); *G10D 13/08* (2013.01); *G10G 7/00* (2013.01); *G10H 1/32* (2013.01); *G10K 11/002* (2013.01); *G10K 11/004* (2013.01); *H04R 1/08* (2013.01); *G10H 2220/211* (2013.01)

(58) Field of Classification Search

CPC . H04R 1/02; H04R 1/08; G10D 13/08; G10G 7/00; G10H 1/32; G10H 2220/211; G10K 11/002; G10K 11/004

USPC ..... 381/91

See application file for complete search history.

(56) References Cited

U.S. PATENT DOCUMENTS

| | | | |
|---|---|---|---|
| 3,040,137 | A | 6/1962 | Simmons |
| 3,649,737 | A | 3/1972 | Jespersen |
| 3,653,625 | A | 4/1972 | Plice |
| 4,151,777 | A | 5/1979 | Sugiyama et al. |
| 4,194,096 | A | 3/1980 | Ramsey |
| 4,201,107 | A | 5/1980 | Barber, Jr. et al. |
| 4,396,807 | A | 8/1983 | Brewer |
| 4,514,598 | A | 4/1985 | Plice |

(Continued)

*Primary Examiner* — Quynh H Nguyen

(74) *Attorney, Agent, or Firm* — Crowell & Moring LLP

(57) ABSTRACT

Improvements in a motorized microphone rail system for a musical instrument and more particularly for a percussion instrument such as a drum, marimba or similar musical instrument. The microphone system includes a vibration isolation system. A vertical or horizontal tracking system bridges across supports of a drum or marimba in a vertical or horizontal tracking system. One or more microphones are supported on the first bridging structure. The microphone(s) are positional with a drive screw that is powered by a motor. The microphone can be moved along the supporting rail to alter the sound based upon the phasing of the sound wave between the drum heads or the sound producing elements. Electronic drive and control for operating a motor that positions the microphone is also disclosed.

10 Claims, 9 Drawing Sheets

(56) References Cited

U.S. PATENT DOCUMENTS 4,546,950 A 10/1985 Cech
4,648,302 A 3/1987 Bozzio
4,791,674 A 12/1988 Drever
4,903,563 A 2/1990 Mizuguchi
4,991,220 A 2/1991 Wolf
5,515,726 A 5/1996 Welsh
5,588,257 A * 12/1996 Duhame ..... E05F 15/673 49/199
5,673,593 A * 10/1997 Lafferty ..... F16H 25/2015 192/141
5,684,258 A 11/1997 Liao
5,757,943 A 5/1998 Arledge, Jr.
5,848,166 A 12/1998 Fisher et al.
6,096,955 A 8/2000 Heide
6,459,802 B1 10/2002 Young
6,502,793 B1 1/2003 Sargent
6,815,598 B1 11/2004 Liao
6,881,080 B2 4/2005 Macaluso
6,922,475 B2 7/2005 Hsieh
7,135,634 B2 11/2006 Chen
7,297,863 B2 11/2007 May
7,723,596 B2 5/2010 Kelly
8,063,297 B2 11/2011 May
2005/0109892 A1* 5/2005 Bober ..... A47B 81/064 248/125.2
2005/0236526 A1* 10/2005 Dowell ..... B61L 5/065 246/415 R
2005/0262987 A1 12/2005 Chen
2006/0034732 A1* 2/2006 Bargh ..... G01N 35/1074 422/400
2006/0272490 A1 12/2006 May
2007/0144329 A1 6/2007 Hollander
2007/0295189 A1 12/2007 Kelly
2008/0144876 A1 6/2008 Reining
2008/0151400 A1 6/2008 Gonzalvo
2008/0205232 A1 8/2008 Matejczyk et al.
2008/0258476 A1 10/2008 Simpson
2011/0259175 A1 10/2011 Mollick
2012/0067197 A1 3/2012 May
2012/0132058 A1 5/2012 Dublin
2014/0169608 A1 6/2014 Hallington
2015/0167956 A1 6/2015 Vaidya

* cited by examiner

MOTORIZED MICROPHONE RAILS

CROSS REFERENCE TO RELATED APPLICATIONS

This application is a continuation of Ser. No. 14/565,864 filed on Dec. 10, 2014, which is a continuation of provisional application 61/914,000 filed on Dec. 10, 2013, the entire contents of which is hereby expressly incorporated by reference herein.

BACKGROUND OF THE INVENTION

This invention relates to improvements in a motorized microphone rail. More particularly, the present supporting microphone(s) that is securable to any mallet pitch percussion instruments includes a vibration isolation structure that suspends a tracking system on the illustrated marimba and a separate vibration isolation structure that isolates each microphone from the tracking system.

Several products and patents have been used to receive the musical sound from a marimba, drum or similar percussion instrument. Most of these devices either are secured to each sound bar or secured to a microphone placed over the sound bars or under the drum head. Exemplary examples of patents covering these products are disclosed herein.

U.S. Pat. No. 4,903,563 issued Feb. 27, 1990 to Masaaki Mizuguchi discloses a sound bar electronic musical instrument such as a marimba. At least some of the sound bars have their own microphone. When a sound bar is struck a tone generator makes the sound through a speaker. This patent does not use all the actual sound from the marimba, the sound is produced from a tone generator.

U.S. Pat. No. 4,151,777 issued May 1, 1979 to Keiicki Sugiyama et al., discloses a piano sound pickup method and device. The pickup and device is placed between a wall of a piano case in opposed direction with a sounding board. The location of the microphone is fixed within the piano and can receive mechanical vibration. Since the single microphone is fixed to a single location there is limited ability to adjust the microphone to receive sound from all of the strings equally or from a particular grouping of strings.

U.S. Pat. No. 6,096,955 issued Aug. 1, 2000 to Jan Anno Ter Heide discloses a device for supporting a musical instrument such as a xylophone, marimba or drum. The structure is a frame having supports on the opposing sides of the musical instrument. The frame legs have wheels or casters that allow the structure, and mounted instrument, to be moved. This patent does not include a microphone or sound pick-up device it provides a frame structure for attaching a xylophone or marimba.

U.S. Pat. No. 3,653,625 on Apr. 4, 1972 to Gerald W. Plice discloses a microphone shock-mounting apparatus. The mounting apparatus uses a cylindrical shock absorber to hold the body shaft of a microphone. This shock absorber is for a microphone and will hold a microphone; the microphone is mountable on a boom fitting or a desk base.

The inventor has also received a number of patents for mounting a microphone within a drum shell, namely these patents are U.S. Pat. Nos. 4,168,646, 4,570,522 and 6,121,528.

What is needed is an adjustable shock mount base for one or multiple microphones between the resonator tubes. The ideal system would allow a performer to power a motor that moves or adjust the location of the microphones to change the proximity of the microphones to the resonator tubes and the sound bars. This ideal system would isolate mechanical noise and sound from instrument and cable movement. The proposed marimba suspended microphone system satisfies the need with a powered suspended microphone system that is adjustable by the user.

It is an object of the motorized microphone rail to suspend the microphones from shock mounts that isolate unwanted mechanical energy/frequency from the microphones and from the audible sound from those unwanted mechanicals. This reduces or eliminates the frame noise and or sounds when a performer or other person makes contact with the frame or drum shell where the microphones are mounted to a percussion instrument(s). The shock mounting of the microphone(s) is secured to a mounting system that is secured to the frame or drum shell of the pitch percussion instrument(s).

It is an object of the motorized microphone rail to provide a suspended frame for suspending the microphones. The suspended microphone frame is also shock mounted to the frame of the mallet pitch percussion instruments and drum shell to further reduce or eliminate mechanical vibration from the frame or drum shell to the microphones. The suspended microphone frame is preferably removably secured to the mallet pitch percussion instruments frame. The suspended frame is removably secured to the mallet pitch percussion instruments frame with plates placed on the opposing ends of the suspended frame and the hook and loop fasteners, pins that rest in a saddles or similar securing means.

It is an object of the motorized microphone rail for microphones to be positionable on the mallet pitch percussion instruments. The positioning can be by sliding one or more microphones along the suspended tubing. The microphones can also be positioned by altering the angle of the microphone on the mounting hardware. In a drum installation the distance of the microphone to the drum head alters the tonal characteristics of the amplified sound.

It is an object of the motorized microphone rail for microphones to be secured with standard microphone mounting that allows a user to mount standard microphones and standard microphone hardware on the isolated frame tube.

It is still another object of the motorized microphone rail for microphones to include a motor, transmission and a screw connected to a drive nut. A microphone is connected to the drive nut. A power supply drives the motor to move the microphone between drum heads or between sound producing elements to alter the pick-up location. A control unit connects the power supply to the motor to set the direction of travel.

It is another object of the motorized microphone rail for microphones to incorporate a cable management system that retains at least a portion of the microphone cables. The cable management system keeps the cables from moving when the mallet pitch percussion instruments is being moved or played. Movement of the cables creates undesirable mechanical noise that the cable management system significantly reduces or eliminates.

It is another object of the motorized microphone rail for microphones to include a blend module that allows a performer to mix or blend the sound from one or multiple microphones. A performer may wish to actively alter or change the amplified sound to account for playing style, acoustics or preference. The blend module can accommodate a portion of this need without requiring the performer to climb under the mallet pitch percussion instruments while performing. The blender further allows a performer or sound technician to adjust the phasing of sound from multiple microphones.

It is still another object of the motorized microphone rail for microphones to secure the microphones in a structure that is fixedly secured to the mallet pitch percussion instruments. The fixed securing will still need to isolate the microphones from mechanical sounds and unwanted percussion sympathetic vibration. The fixedly securing allows the microphones to be moved with the mallet pitch percussion instruments without disassembly of the microphones and or the mallet pitch percussion instruments.

It is still another object of the motorized microphone rail for the drive system to operate in multiple speeds of operation and to utilize limit switches or current limiting to safely stop to motor. The drive circuit can operate locally with switches or at a distance with a wireless remote.

Various objects, features, aspects, and advantages of the present invention will become more apparent from the following detailed description of preferred embodiments of the invention, along with the accompanying drawings in which like numerals represent like components.

DETAILED DESCRIPTION OF THE DRAWINGS

Figure 1:
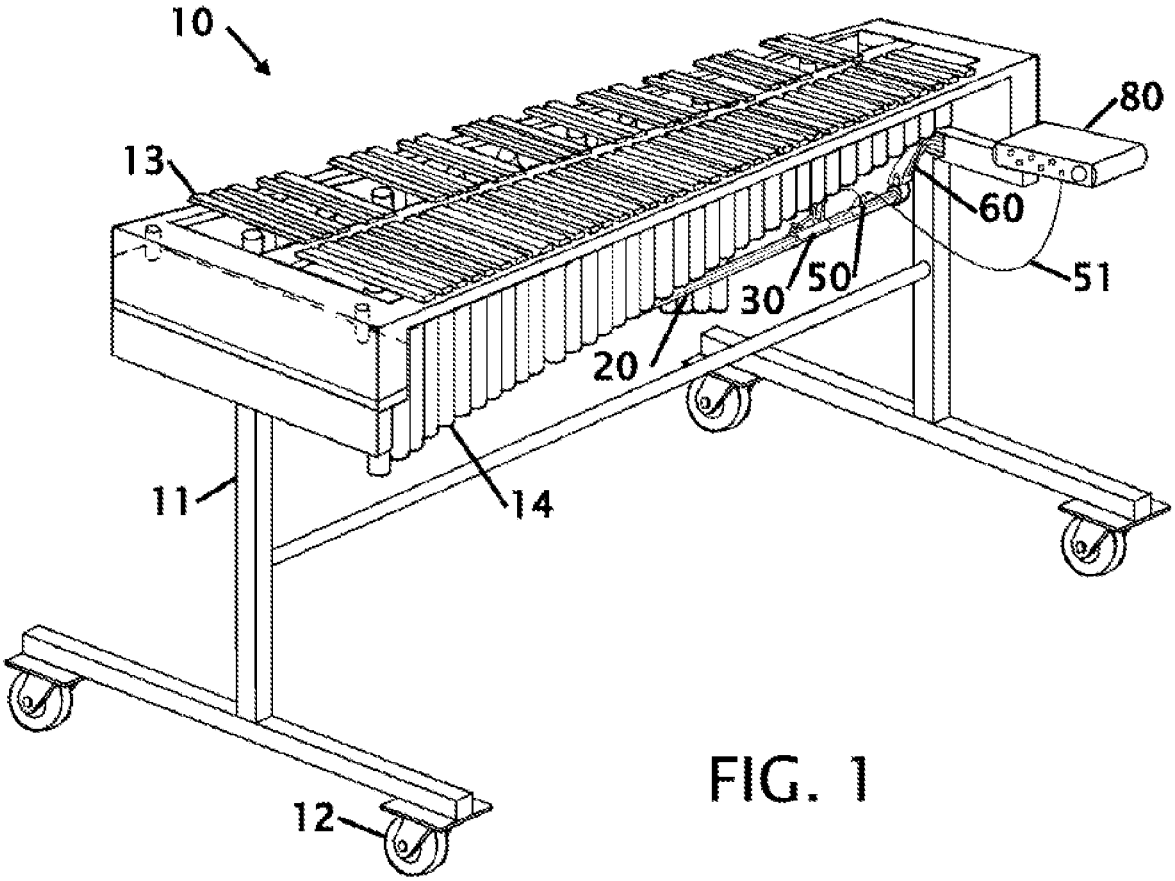
FIG. 1 shows an isometric view of the mallet pitch percussion instruments microphone suspension system mounted on a mallet pitch percussion instruments.

The above-described drawing figures illustrate the disclosed invention in at least one of its preferred, best mode embodiments, which are further defined in detail in the following description. Those having ordinary skill in the art may be able to make alterations and modifications to what is described herein without departing from its spirit and scope. While this invention is susceptible of embodiment in many different forms, there is shown in the drawings and will herein be described in detail at least one preferred embodiment of the invention with the understanding that the present disclosure is to be considered as an exemplification of the principles of the invention and is not intended to limit the broad aspects of the invention to any embodiment illustrated. Therefore, it should be understood that what is illustrated is set forth only for the purposes of example and should not be taken as a limitation on the scope of the disclosed invention.

FIG. 1 shows an isometric view of the mallet pitch percussion instruments microphone suspension system mounted on a mallet pitch percussion instruments. While a mallet pitch percussion instruments 10 is shown and described the microphone suspension mounting system is compatible with similarly configured musical instruments including a xylophone. The mallet pitch percussion instruments has a plurality of sound bars 13 with resonance tubes 14 extending under the sound bars 13. Since the performer moves over the top of the sound bars as they strike the sound bars placing a microphone above the sound bars is difficult. In addition, because there are two rows of resonance tubes located under the sound bars, placement of a microphone under or between the resonance chambers is difficult.

In general a mallet pitch percussion instruments support frame 10 is configured on a frame structure 11. The frame structure shown has caster(s) 12 mounted to the bottom of the frame structure 11 to allow the mallet pitch percussion instruments to be moved in the frame structure 11. The frame structure 11 has upright members that support the mallet pitch percussion instruments 10. The microphone suspension system mounts between the opposing upright legs. A microphone (shown between the resonance tubes) is mounted onto a microphone slide mount 30. The microphone slide mount allows the microphone to be repositioned along the mounting tube or isolated frame tube 20. On the opposing sides of the isolated frame tube 20 are end suspension horns 60 that secure the sub assembly to the mallet pitch percussion instruments. The end suspension horn(s) are shown and described in more detail in FIGS. 2 and 6 herein.

Each microphone has a cord 51 and in this figure the microphone cord 51 loops through a cable management clip 50 before connecting to a mixer blender 80. The mixer blender allows the signal from one or more microphones to be separately amplified and blended before being sent to a power amplifier (not shown). The mixer blender is shown and described in more detail with the inventor's prior application Ser. No. 11/144,542, now U.S. Pat. No. 7,297,863.

Figure 2:
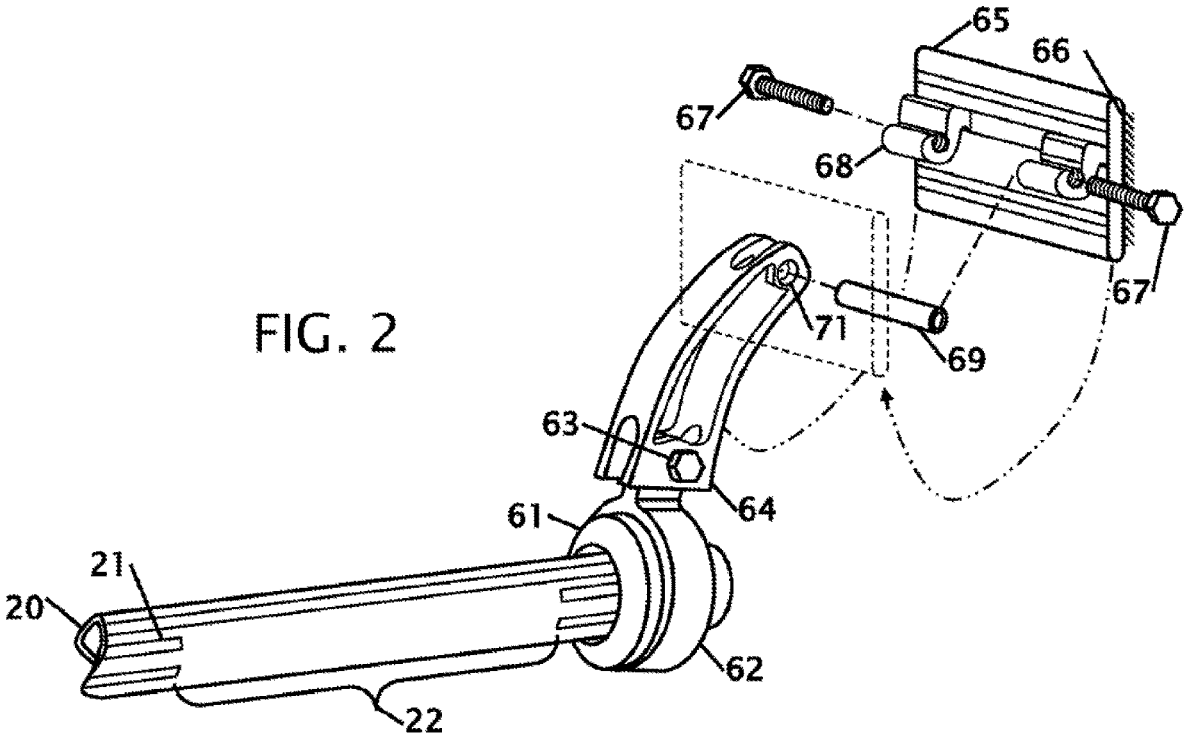
FIG. 2 shows a detailed view of the end support for the isolated frame structure.

FIG. 2 shows a detailed view of the end support for the isolated frame structure. This section of tube 20 can be similarly secured on both ends between the resonance chambers of the mallet pitch percussion instruments. The tube section is fluted or dove tailed 21 to allow elements to slide along the length of the tube without the elements spinning due to gravity or vibration. A portion 22 of the tube has been smoothed to allow dovetailed or fluted elements to be placed onto the flutes or dovetails without requiring a free end of the tube 20. The tube 20 is isolated from the frame with an isolator(s) that fits around the tube 20 ends. The isolator 61 has a support 62 that extends around the isolator 61. The support 62 is fitted onto a horn 64 with a fastener 63. At the end of the horn 64 apivotable foot 65 (shown exploded from the horn 64) is mounted onto a hollow elastomeric bushing 69 that is passed through hole 71 in the horn 64. The foot 65 is then placed onto the elastomeric bushing 69 and fasteners 67 are threaded into the saddle(s) 68 on the foot 65 where the end of the fastener(s) 67 extends into the hollow elastomeric bushing 69. Various other vibration isolation securing methods are contemplated that provide similar isolation. Some variation include but are not limited to a custom bushing, turning down the end of the threaded portion of the fasteners 67 and placing an additional elastomeric bushing in the connection between the horn 64 and the support 62. In the preferred embodiment the foot 65 uses a hook and loop 66 type fastening system to secure the feet 65 to the mallet pitch percussion instruments frame. The mounting of the tube 20 to the frame 10 provides isolation from mechanical vibration that can be detected by the microphone and subsequently an amplifier.

It is contemplated that the isolator 61, horn 64 and the foot 65 could be made from a single isolation member such as a rubber type material that will provide both rigid support and vibration isolation. The horn and or angled pieces does not need to be made from rigid material such as extruded aluminum but could be molding or a hard rubber extrusion then cut to length finished with a fastener for mounting. While a hook and loop securing system is shown and described other mounting systems are contemplated including but not limited to placing the tube 20 unto a supporting channel or using pins that extend into the sides of the mallet pitch percussion instruments frame.

The transverse tube 20 could also be secured to the frame of the mallet pitch percussion instruments using bungee cords or a transverse trapeze that isolates the tube from the frame of the mallet pitch percussion instruments. The isolation of the tube 20 from the frame 10 provides more omni-directional energy absorbing to minimize or eliminate mechanical noise to the microphones. The fasteners 63 and or 67 can be adjusted to allow the isolated frame tube 20 to swing or rigidly be secured depending upon desire or requirements. As previously identified, the isolation tube 20 is fluted or dovetailed and a portion of the isolation tube 20 has the flutes removed for placement of the microphones.

Figure 3:
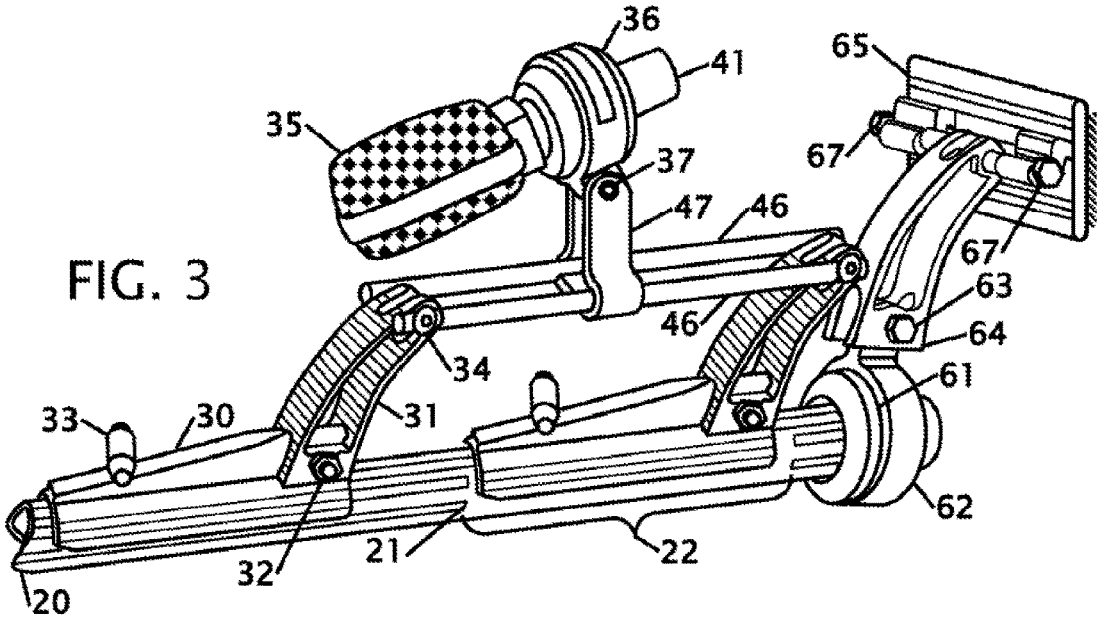
FIG. 3 shows a microphone suspended from a flexible tightrope type cord.

FIG. 3 shows a microphone suspended from a flexible tightrope type cord. The isolated frame tube 20 and its connection with the horn 64 to the foot 65 is the same as described with FIG. 2. In this figure the foot 65 is secured to the bushing and the horn 64 with bolts 67. The horn 64 is fastened to the support 62 with a fastener 63. The isolated frame tube 20 extends through an isolator 61. The tube section of the isolated frame tube 20 is fluted or dove tailed 21 to allow elements to slide along the length of the tube without the elements spinning due to gravity or vibration. A portion 22 of the tube has been smoothed to allow dovetailed or fluted elements to be placed onto the flutes or dovetails without requiring a free end of the tube 20.

The microphone slide support 30 has dovetail inwardly turned edges that engage into corresponding dovetail edges or grooves that are in the isolated frame tube 20. The dovetail edges or grooves maintain the orientation of the microphone and provide a sliding surface for the microphone sub assembly to slide along the isolated frame tube. A lock 33 secures the position of the microphone sub assembly on the isolated frame tube. A horn 31 is secured to the microphone slide mount 30 with a fastener 32 such as a screw, bolt or similar securing means.

Two separate microphone support slides 30 with horns 31 are shown with flexible tightropes 46 stretched between the horns 31 and secured with a clamp or fasteners 34. The tightropes 46 are flexible to dampen unwanted vibration of the frame to the microphones 35. A clamp 47 is secured to the tightropes 46 and a fastener 37 secures the clamp 47 to the isolator 36. The microphone handle slides through the isolator 36 and the cable for the microphone suspension connects to the end 41 of the microphone handle.

Figure 4:
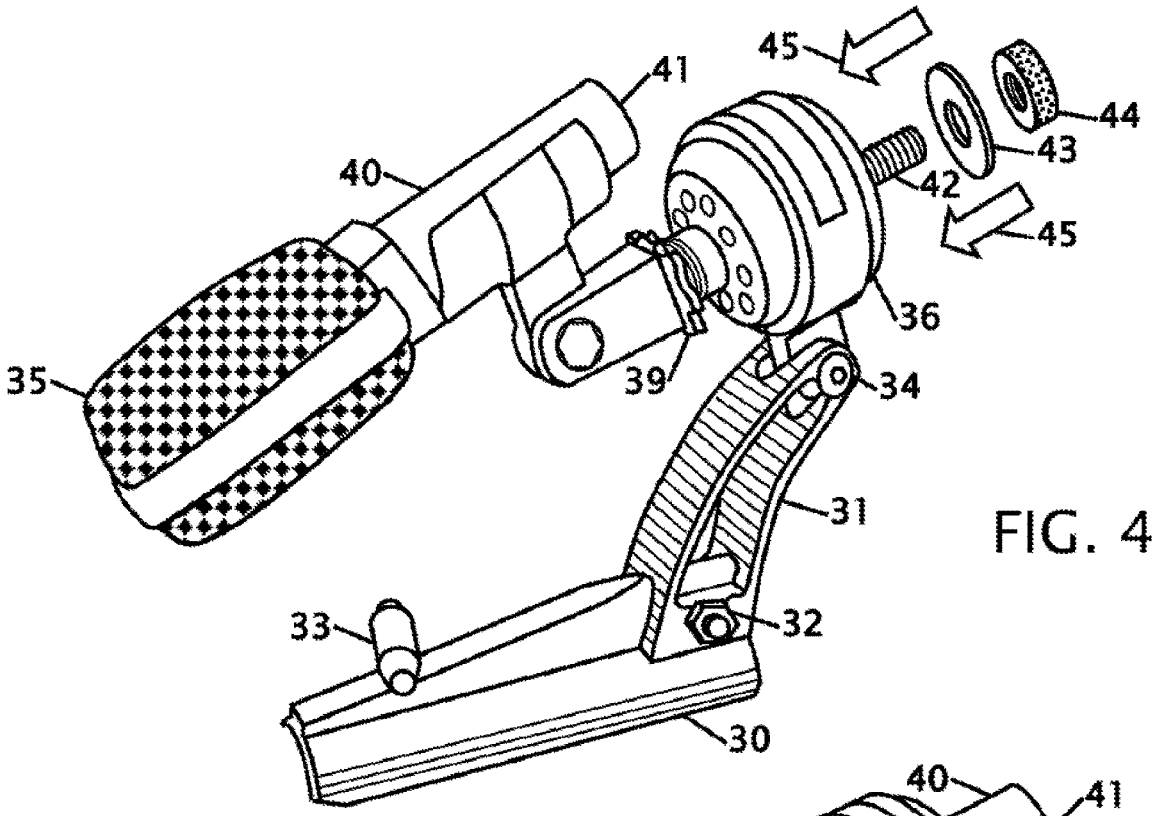
FIG. 4 shows a first preferred embodiment of a microphone mounted into an isolator.
Figure 5:
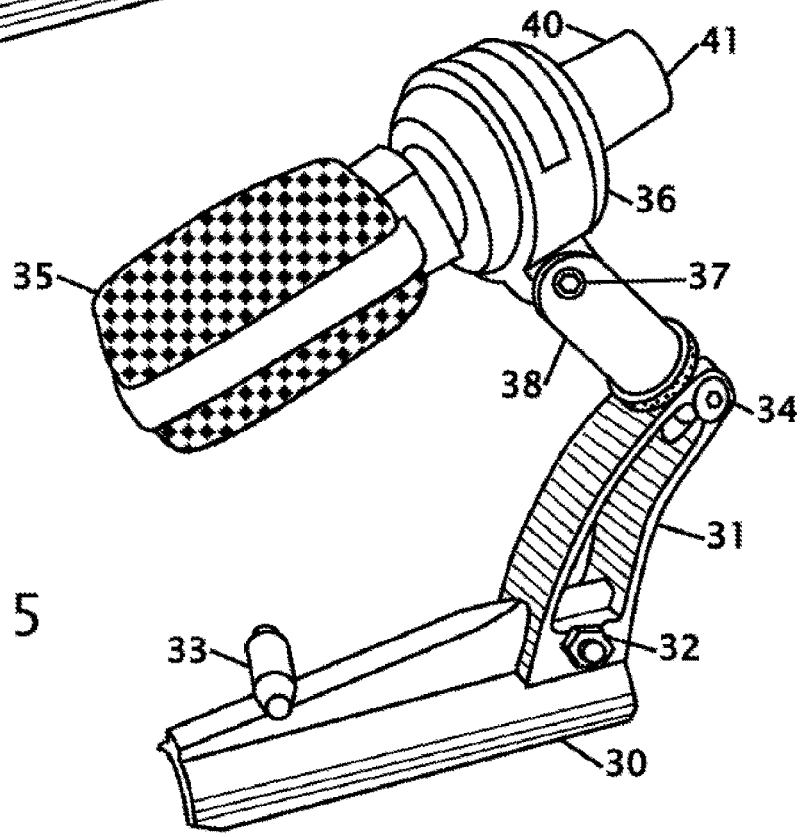
FIG. 5 shows a second preferred embodiment of a microphone mounted into an isolator.

FIG. 4 shows a first preferred embodiment of a microphone suspension mounted into an isolator. FIG. 5 shows a second preferred embodiment of a microphone mounted into an isolator. In both embodiments the base of the sub assembly is a microphone slide support 30. This slide support is similar in construction to the slide support that is used in the instrument carrier disclosed by the inventor in patent application Ser. No. 11/021,596 now U.S. Pat. No. 7,326,842. The slide support 30 engages onto the isolated frame tube 20 in FIGS. 1, 2, 5 and 6. The microphone slide support has dovetail inwardly turned edges that engage into corresponding dovetail edges or grooves that are in the isolated frame tube 20. The dovetail edges or grooves maintain the orientation of the microphone and provide a sliding surface for the microphone sub assembly to slide along the isolated frame tube. A lock 33 secures the position of the microphone sub assembly on the isolated frame tube. A horn 31 is secured to the microphone slide mount 30 with a fastener 32 such as a screw, bolt or similar securing means. The horn 31 is similar in construction to the horn shown and described in the inventor in patent application Ser. No. 11/021,596 now U.S. Pat. No. 7,326,842. Two different types of supporting hardware secure the microphone.

In FIG. 4 an isolator 36 secures the microphone clamp in a microphone stand that is similar in construction to how a microphone would be mounted on a microphone stand. The isolator 36 is secured with a threaded shaft 42 on one end and a thumbnut 39 that thread into the microphone stand base. The microphone mount is secured through the isolator 36 with a threaded shaft 42. A washer 43 and thumb nut 44 is threaded onto the threaded shaft 42. Tightening or loosening the thumbnut down 45 onto the isolator will alter the rigidity of the isolator 36 thereby altering the dampening of mechanical sounds and unwanted percussion sympathetic vibration. The microphone has a screen 35 that covers the pick-up area and a shaft or handle 40 for mounting. The cord would connect to the end 41.

In FIG. 5 the shaft or handle 40 of the microphone is directly mounted into the isolator 36. An extension 38 connects the horn 31 to the isolator 36 using securing hardware 34 and 37 at each end of the extension. The connection cable for the microphone would extend out the end 41 of the shaft or handle of the microphone. While fasteners such as screws are shown and described other types of securing hardware are contemplated including clips, springs, pins, glues, adhesives, snaps or frictional engagement. It is also contemplated that the horn and the microphone holding mechanism can all be made from a rubber material that provides both structural strength and isolation of mechanical vibration.

Figure 6:
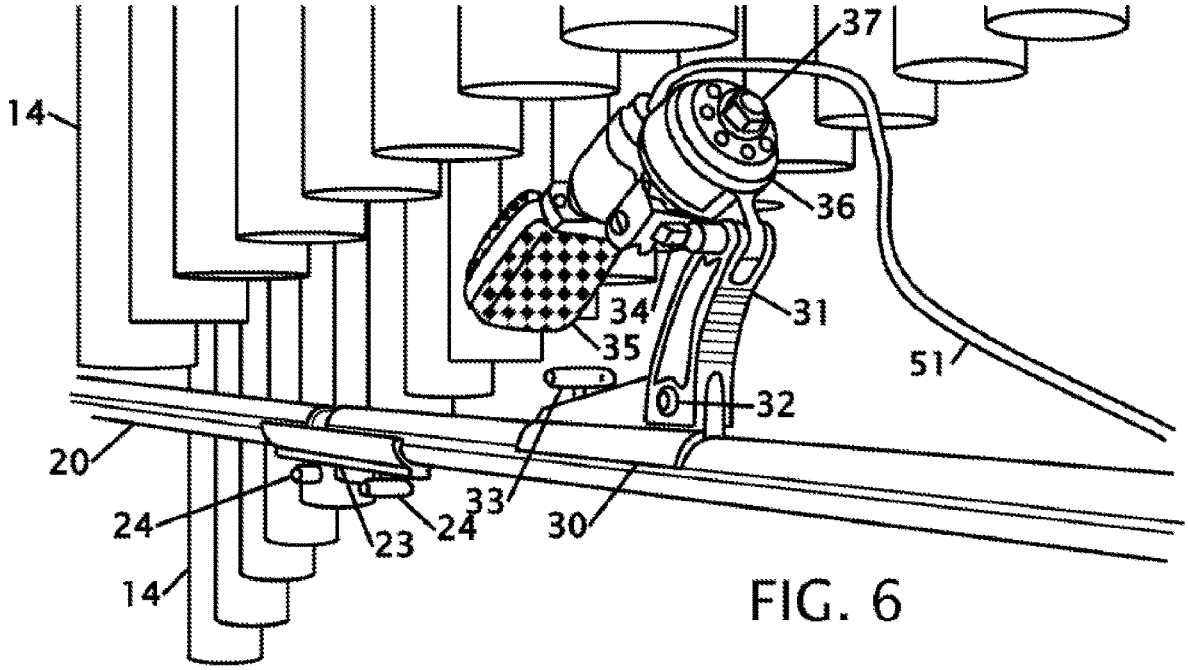
FIG. 6 shows the microphone from FIG. 3 mounted between the resonances tubes on the isolation frame.

FIG. 6 shows the microphone from FIG. 3 mounted between the resonances tubes on the isolation frame. This figure shows the placement of the microphone 35 between the resonance tubes 14 of the mallet pitch percussion instruments. The microphone 35 is mounted onto the isolated frame tube 20 using the microphone slide mount 30 with horn 31. The microphone slide mount 30 can be locked in place on the isolated frame tube 20 with lock 33. Various fasteners 32, 34 and 37 hold the microphone 35 in position. One or more of these fasteners 32, 34 and 37 can be loosened to alter the position and angle of the microphone 35 between the resonance tubes 14. Isolator 36 isolates any mechanical vibration of the mallet pitch percussion instruments frame to the microphone. The microphone cord 51 connects from the back of the microphone through a cable management clip shown in FIG. 7 and then to an amplifier or to a level compensator mixer as shown and described with FIG. 1.

The isolation frame tube 20 is shown in two pieces with a joiner 23 connecting the two isolated frame tube pieces 20. The joiner 20 engages into the dovetail grooves or recesses. This joiner is similar in construction to the joiner shown and described in the inventor's prior U.S. Pat. No. 7,438,266. Locks 24 secure the position of the joiner 20 onto each of the two isolated frame tube pieces 20.

Figure 7:
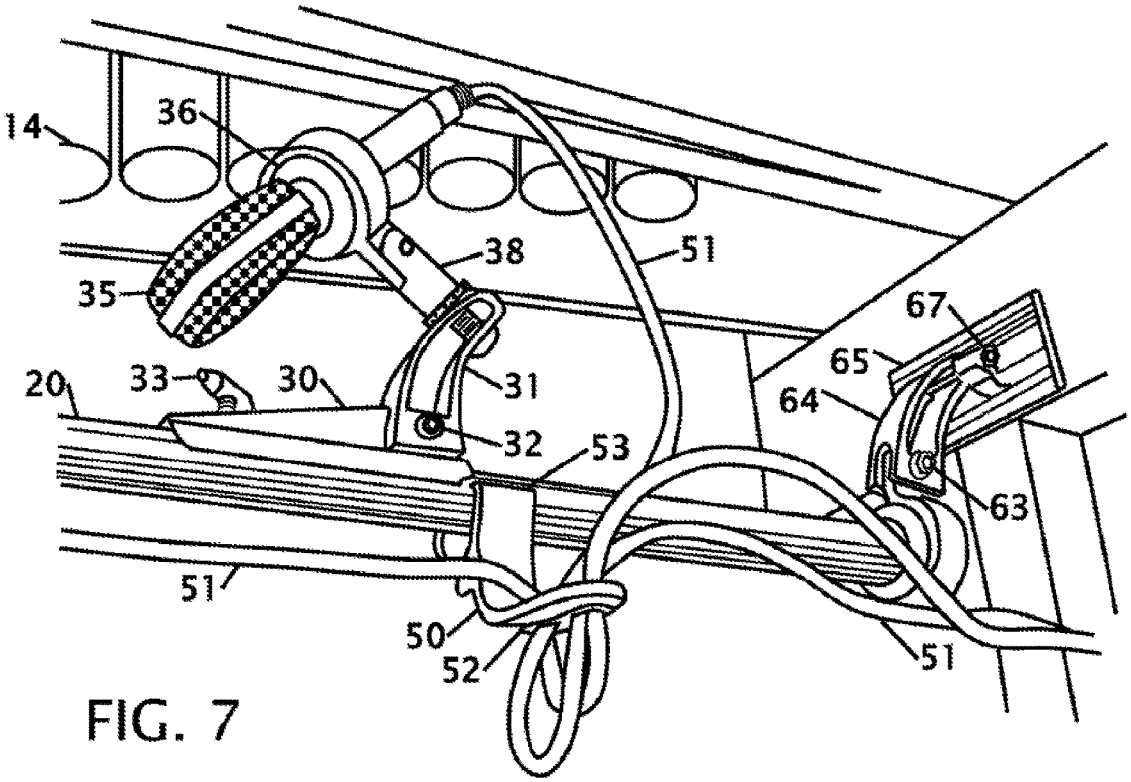
FIG. 7 shows the microphone from FIG. 4 mounted on a mallet pitch percussion instruments with a cable management system.

FIG. 7 shows the microphone from FIG. 5 mounted on a mallet pitch percussion instruments with a cable management system. The microphone and the microphone mounting are similar to previously described configuration where like number correspond to like components. The end suspension horn is similar to previously described configuration where like numbers correspond to like components. The major addition in this figure is the cable management clip 50. In this figure the cable management system is clipped to the dovetail grooves or tabs in the isolated frame tube 20 with clip tabs 53 located at the ends of the cable management clip. The cable management clip 50 prevents or reduces mechanical noise from cable movement from being picked-up or heard in the microphones. An extended tab on the cable management clip 50 has a slot 52 where cables are placed through to capture the cable and to offset gravity and sway of the microphone cable(s) 51.

Figure 8:
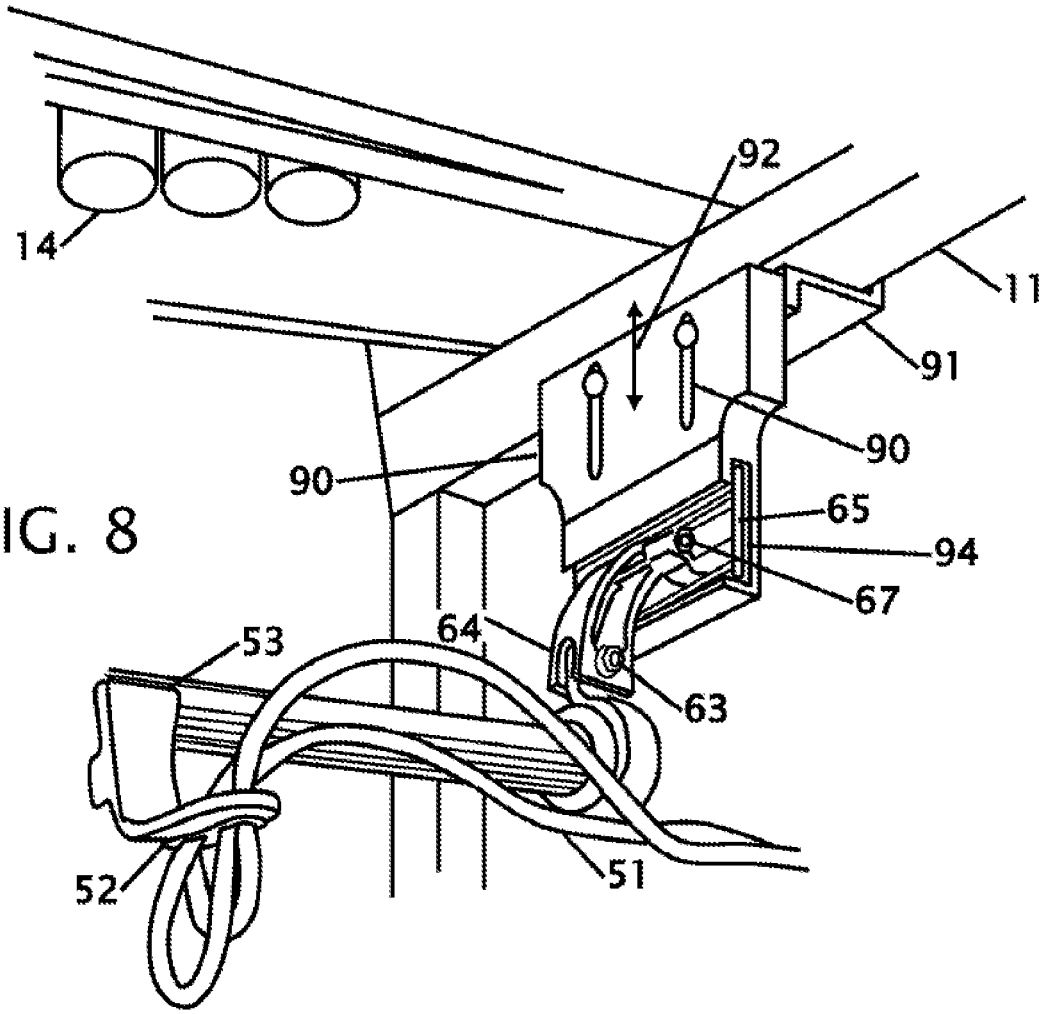
FIG. 8 shows the microphone suspension structure from FIG. 6 with a vertically adjustable frame mounting bracket.
Figure 9:
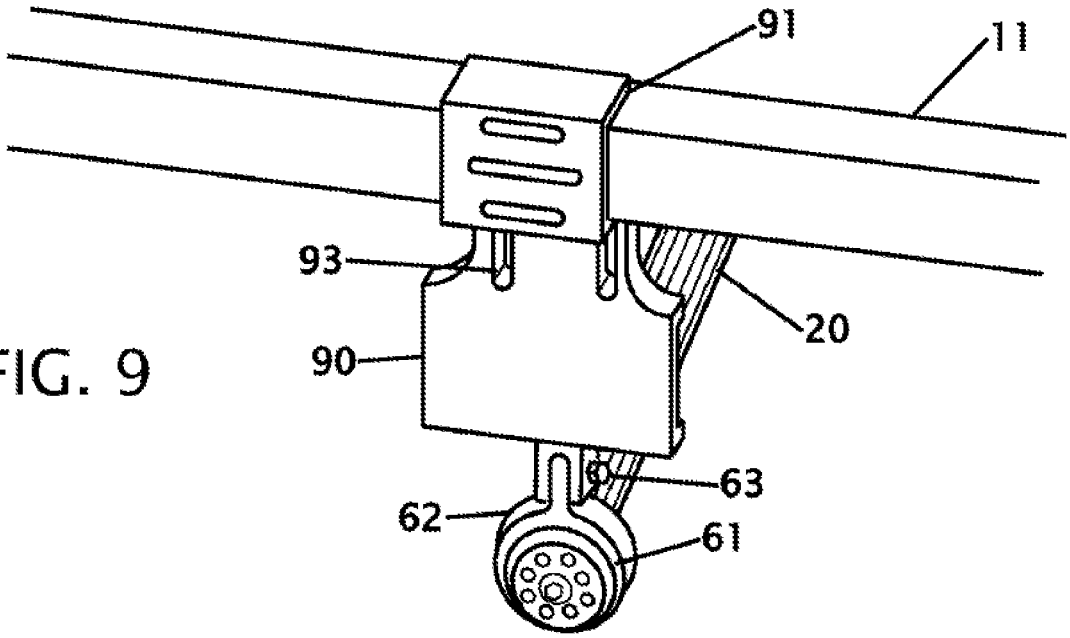
FIG. 9 shows an alternate view of the vertically adjustable frame mounting bracket from FIG. 8.

FIG. 8 shows the microphone suspension structure from FIG. 6 with a vertically adjustable frame mounting bracket and FIG. 9 shows an alternate view of the vertically adjustable frame mounting bracket from FIG. 8. In these figures the foot 65 is shown inserted into the foot retentions hanger 90. The foot is slid into the recess 94 where it is retained. The foot retaining hanger 90 is secured to a frame hook 91 that fits around an existing mallet pitch percussion instruments support frame 11. One or more slots 90 allows the microphone suspension structure to be moved 92 vertically to adjust the height of the microphones between the resonance tubes 14.

Figure 10:
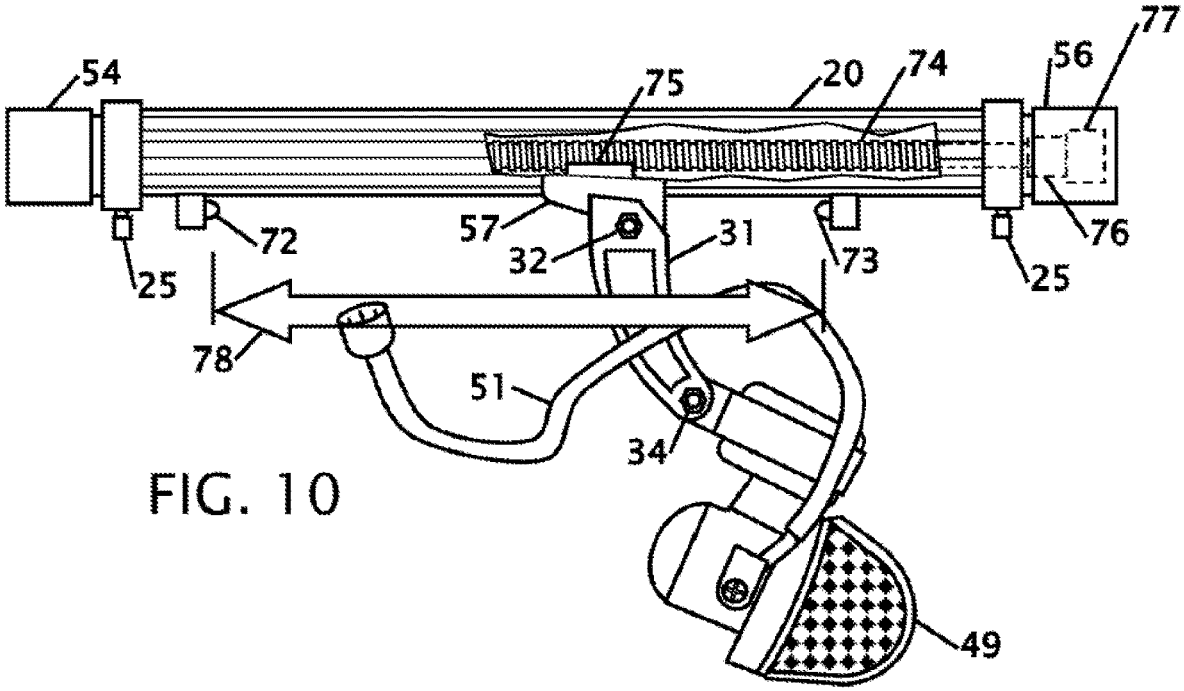
FIG. 10 shows a side view of a microphone mounted on a frame tube with the motorized drive shown in the broken-away section.
Figure 11:
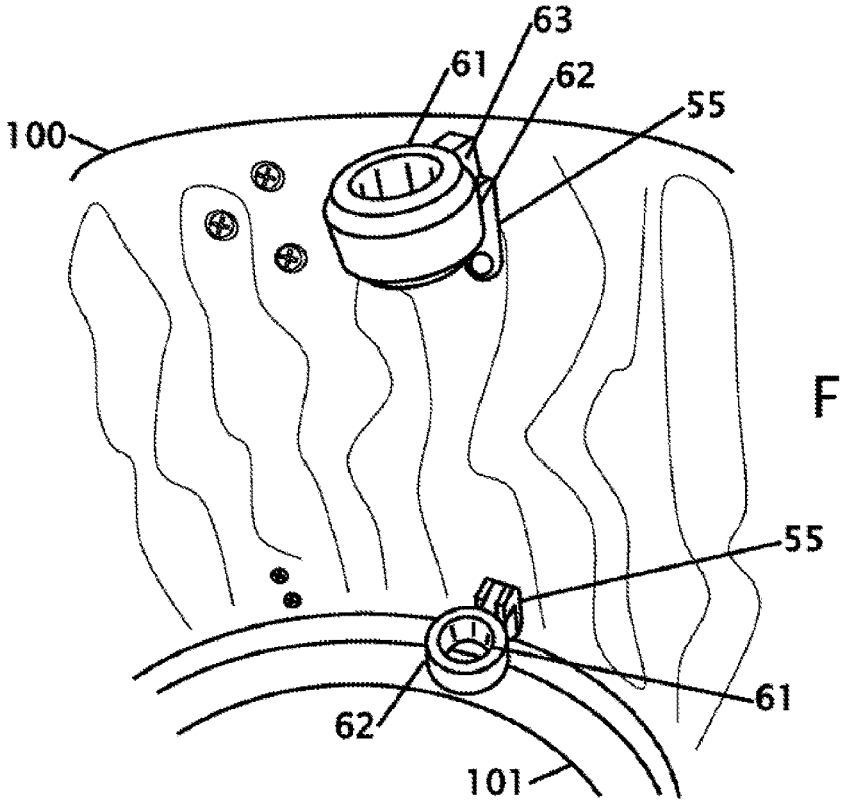
FIG. 11 shows a perspective view of the isolators installed on a drum.
Figure 12:
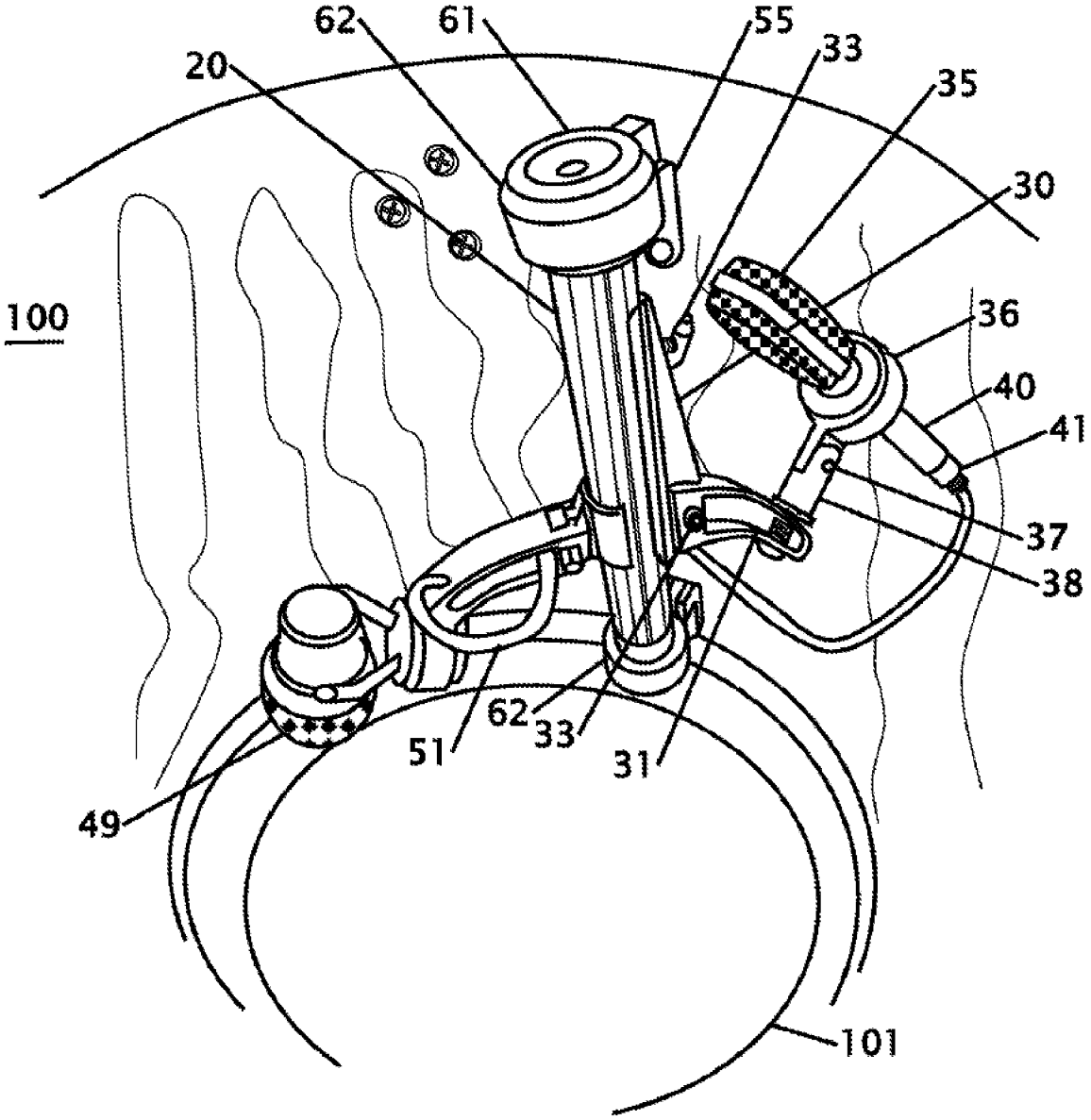
FIG. 12 shows a perspective view of the frame rail of FIG. 10 mounted within the drum from FIG. 11 with an additional microphone.

FIG. 10 shows a side view of a microphone mounted on a frame tube with the motorized drive shown in the broken-away section, FIG. 11 shows a perspective view of the isolators installed on a drum and FIG. 12 shows a perspective view of the frame rail of FIG. 10 mounted within the drum from FIG. 11 with an additional microphone. The supporting structure of this embodiment used similar or the same components as on the marimba. The major difference is that the support 62 and isolators 61 are mounted on a foot 55 that allows the sub assembly to mount within the shell 100 of a drum between the drum heads or under the drum head 101. The microphone slide mount 48 allows the horn 31 and the microphone 49 to translate along the isolated elongated supporting rail 20. The ends of the 54 of the isolated frame tube are secured within the isolators 61.

These figures shows the placement of the microphone 35 or microphones as shown in FIG. 12 within the drum shell 100 of the percussion instruments. The microphone(s) 35 and 49 is mounted onto the isolated frame elongated supporting rail 20 using the microphone slide mount 30 with horn 31. The microphone slide mount 30 can be locked in place on the isolated frame elongated supporting rail 20 with lock 33. Various fasteners 25, 32, 34 37, and 63 hold the microphone 35 in position. One or more of these fasteners 25, 32, 34, 37 and 63 can be loosened to alter the position and angle of the microphone 35 between the ends of the drum or without the drum heads. Isolator 36 isolates any mechanical vibration of the mallet pitch percussion instruments frame to the microphone. The microphone cord 51 connects from the back of the microphone through the horn 31 or with a cable management clip shown in FIG. 7 and then to an amplifier or to a level compensator mixer as shown and described with FIG. 1.

The motorized drive section in FIG. 10 uses a motor 77. The motor 77 and transmission 76 are mounted within the one of the isolation connection members 56. While the motor 77 and transmission 76 is shown mounted with the end support 56 they can be mounted in other locations that drive a screw 74. The screw 74 is connected to an output shaft of the transmission 76. The transmission converts the high rotation of the motor to a slower rate of rotation.

In the preferred embodiment the transmission rotates at 4 to 100 RPM. The rate of rotation is selected based upon the desired rate of liner motion 78 of the microphone 49. The drive screw 74 is threaded or otherwise coupled 75 to nut 57 or segment of a nut or rack. The nut 57 is secured to the microphone 49 and moves 78 when the motor 77 is energized. Limit switched 72 and 73 prevent motion of the nut 57 outside of the desired extent of travel. From this figure limit switch 73 is shown placed closer to the center of the rail. This more central location prevents the microphone 49 from making contact with a drum head.

In FIG. 12, the shaft or handle 40 of the microphone is directly mounted into the isolator 36. An extension 38 connects the horn 31 to the isolator 36 using securing hardware 37 at each end of the extension. The connection cable for the microphone would extend out the end 41 of the shaft or handle of the microphone.

Figure 13:
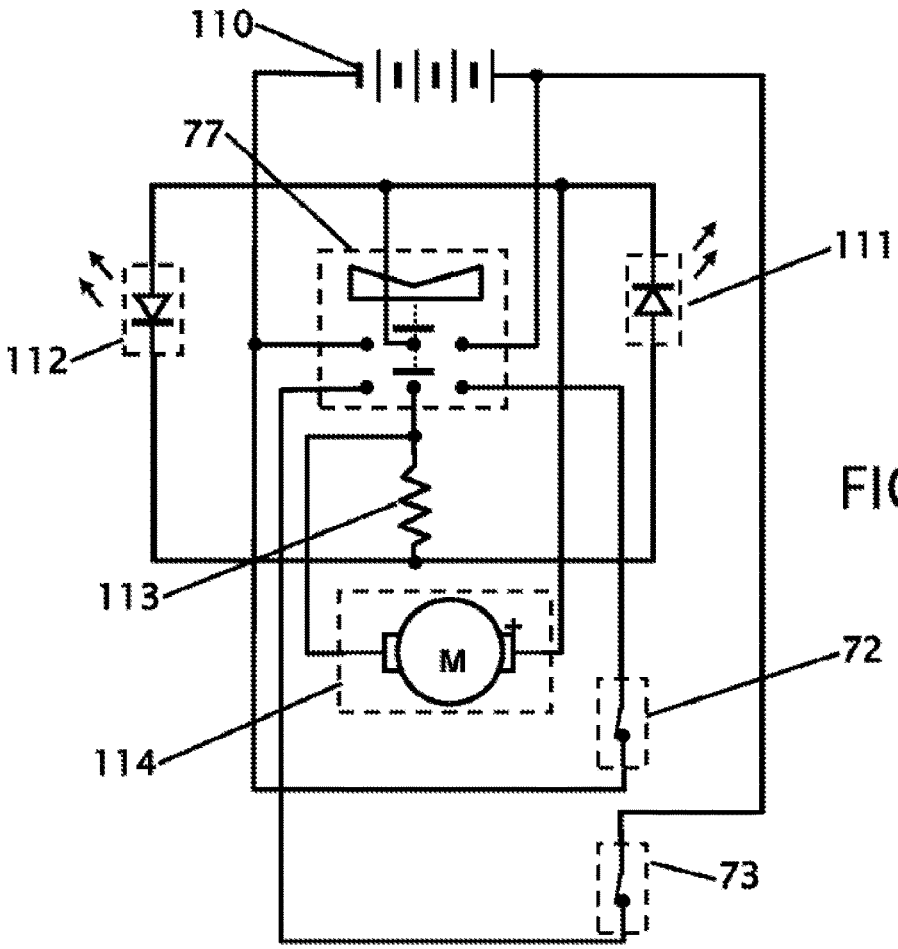
FIG. 13 shows a circuit diagram for the motorized drive and control.

FIG. 13 shows a circuit diagram for the motorized drive and control. The drive motor 114 is powered by a power supply 110. The power supply is a DC power source and power is supplied to the motor 114 based upon the position of the switch 77. The switch 77 is normally held in a central location. Depressing the switch 77 is a first side connects DC power is a first polarity to the motor 114. When the switch 77 is depressed in a second direction the power from the motor 114 is provided in an inverse polarity to drive the motor 114 is an opposite direction. Limit switches 72 and 73 block power from flowing to the motor 114 when the travel of a nut connected to the motor 114 is at an extreme travel. A single resistor 113 limits current to both LED's 111 and 112. Only one LED can be powered at a single time.

Figure 14:
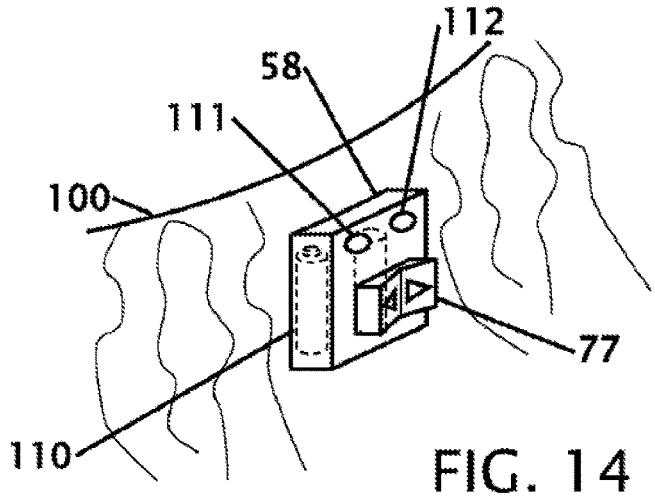
FIG. 14 shows a pictorial diagram of the control mounted on a drum shell.

FIG. 14 shows a pictorial diagram of the control mounted on a drum shell. The control box 58 is shown mounted on the outside of the drum shell 100. While the control box 58 is shown mounted on the drum shell 100 it is also contemplated that the control box 58 could be onto a frame that supports the drum or could also be controlled by a wired or wireless connection distal from the drum, for example at a mixing board using a FM, IF, WiFi or other connection.

In this embodiment the control box has a rocker switch 77. When the rocker switch is depressed in a first direction the batteries 110, or other internal or external power source will energize the motor and turn on an LED 111 or 112 depending upon the direction of travel of the motor. If nut is against a limit switch, power will not be applied to the drive motor and the LED will not be illuminated. The LED illumination allows an operator to know if the motor is in motor or if the nut travel is stopped by a limit switch.

Figure 15:
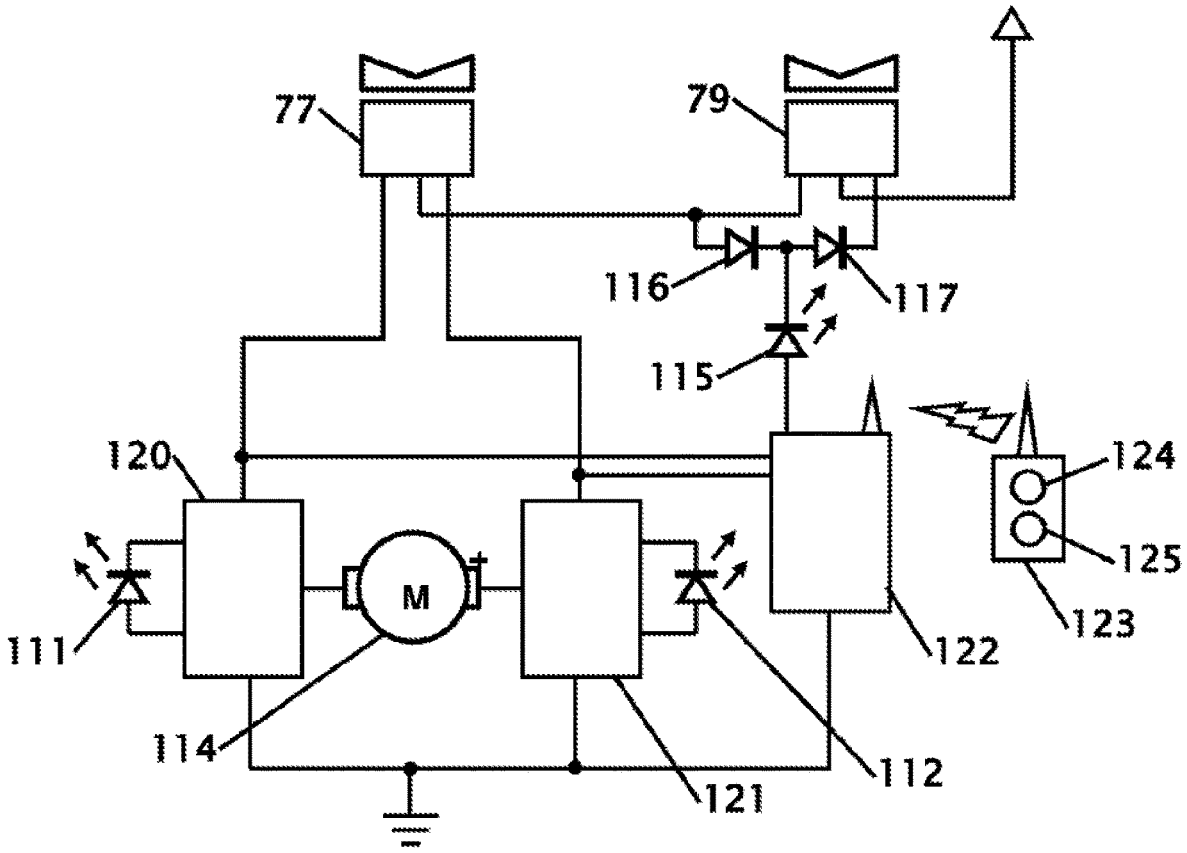
FIG. 15 shows an alternate embodiment of a circuit for the motorized drive and control.

FIG. 15 shows an alternate embodiment of a circuit for the motorized drive and control. In this control circuit the limit switches have been removed and replaced with current limiting circuits 120 and 121. Switch 77 controls the direction of travel of the motor 114. The current limiting circuits 120 and 121 stop providing drive power to the motor 114 when the motor 114 experiences a load. This load is essentially that the motor has reached the end of travel and has come against a hard stop or an obstruction. This circuit protects the motor from being overdriven and potentially being burned out. Indicator LED's 111 and 112 provide a visual clue that the motor is no longer being driven because seeing the location and motion of the microphone can be difficult.

The circuit also includes two speeds of operation with switch 79. In higher speed mode, switch 77 is connected directly to the incoming voltage. In lower speed operation the incoming voltage is regulated by diodes 116 and 117 that reduces the voltage to switch 77. In this lower speed mode power is also supplied to a wireless receiver 112. The motor control cab be with an external power supply or can be with batteries wired to the control circuit.

When lower speed is active an LED 115 provides a visual indicator that the receiver is consuming power and is in operation. A wireless transmitter 123 has two buttons 124 and 125 that sends a wireless signal to the receiver 122 that controls the direction of travel of the motor 114. This allows a person at a distance from the microphone to adjust the position of the microphone. This can be performed with a person at a mixing board to adjust the sound as the performer is performing.

The enabled features of an isolated drum and mallet pitch percussion instruments motorized microphone system that have been described in detail above are considered novel over the prior art of record and are considered critical to the operation of at least one aspect of the invention and to the achievement of the objectives of the invention. It should be apparent, however, to those skilled in the art that many more modifications beside s those described are possible without departing from the inventive concepts herein.

The words used in this specification to describe the exemplary embodiments are to be understood not only in the sense of their commonly defined meanings, but also to include any special definition with regard to structure, material or acts that would be understood by one of ordinary skilled in the art to apply in the context of the entire disclosure. Accordingly, the definitions of the words or drawing elements described herein are meant to include not only the combination of elements which are literally set forth, but all equivalent structures, materials or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim without departing from the scope of the invention.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The foregoing disclosure has been set forth merely to illustrate the invention and is not intended to be limiting. It should be apparent, however, to those skilled in the art that many more modifications besides those described are possible without departing from the inventive concepts herein. Since modifications of the disclosed embodiments incorporating the spirit and substance of the invention may occur to persons skilled in the art, the invention should be construed to include everything within the scope of the appended claims and equivalents thereof. The scope of this description is therefore to be interpreted in conjunction with the appended claims, and the inventive subject matter is not to be restricted except in the spirit of the appended claims.

The invention claimed is:

1. A motorized microphone rail system comprising:

a drive circuit comprising a motor powered by a power supply to drive a drive screw that is internal to an elongating supporting rail, wherein the drive circuit is electronically coupled to a limit structure mounted on an exterior of the elongated supporting rail;

a microphone suspension structure mounted on the exterior of the elongated supporting rail, the microphone suspension structure configured to:

mount a microphone thereon, and couple to the drive screw through the exterior of the elongated supporting rail such that driving of the drive screw via the motor repositions the microphone suspension structure along the exterior of the elongated supporting rail, wherein the limit structure physically obstructs the repositioning of the microphone suspension structure along the exterior of the elongated supporting rail, and wherein contact with the limit structure by the microphone suspension structure causes the drive circuit to cut power to the motor so as to stop the driving of the drive screw.

2. The motorized microphone rail system of claim 1, wherein the drive screw is configured to be driven via a motor temporally connected to a power supply so as to cause a transmission to drive the drive screw to thereby reposition the microphone suspension structure along the elongated supporting rail.

3. The motorized microphone rail system of claim 1, further comprising an elastomeric isolator positioned on the microphone suspension structure so as to be between the microphone and the microphone suspension structure when the microphone is mounted on the microphone suspension structure.

4. The motorized microphone rail system of claim 1, wherein the temporal connection is an at least two position switch that turns the drive screw in a clockwise and a counter-clockwise direction.

5. The motorized microphone rail system of claim 4, wherein the clockwise and the counter-clockwise rotation creates linear travel of the microphone.

6. The motorized microphone rail system of claim 1, wherein the microphone suspension structure is further configured to permit changing or replacing of the microphone.

7. The motorized microphone rail system of claim 1, wherein the microphone, when mounted, is repositionable via movement of the microphone suspension structure along the elongated supporting rail.

8. The motorized microphone rail system of claim 1, wherein the elongated support rail is fluted, and includes a flat surface allowing for mounting and removal of the microphone suspension structure on the elongated support rail.

9. The motorized microphone rail system of claim 1, wherein the microphone suspension structure is further configured such that the angular orientation of the microphone is adjustable.

10. The motorized microphone rail system of claim 2, wherein the microphone suspension structure further includes a wireless receiver whereby the motor is configured to be operated at a distance from the motorized microphone rail.

* * * * *